US005261725A

United States Patent [19]

Rudolph

[11] Patent Number: 5,261,725

[45] Date of Patent: Nov. 16, 1993

[54] LOW-PROFILE POSITIONING APPARATUS

[76] Inventor: Lawrence Rudolph, 895 "C" St., David City, Nebr. 68632

[21] Appl. No.: 800,854

[22] Filed: Nov. 27, 1991

[51] Int. Cl.[5] ..... B60N 2/22

[52] U.S. Cl. ..... 297/361.1; 297/355; 297/DIG. 10; 297/354.13

[58] Field of Search ..... 297/361, DIG. 10, 355, 297/261; 280/32.6, 32.5; 248/129; 182/223

[56] References Cited

U.S. PATENT DOCUMENTS

| | | | |
|---|---|---|---|
| 1,936,973 | 11/1933 | Switzer | 297/355 |
| 2,051,563 | 8/1936 | Mance | 280/32.6 |
| 2,509,934 | 5/1950 | Murray | 280/32.6 |
| 4,372,608 | 2/1983 | Hotta | 297/361 |
| 4,394,047 | 7/1983 | Brunelle | 297/361 |
| 4,790,599 | 12/1988 | Goldman | 297/68 X |
| 4,957,302 | 9/1990 | Maxwell | 297/261 X |
| 5,040,832 | 8/1991 | Zalewski | 297/DIG. 10 X |

FOREIGN PATENT DOCUMENTS

| | | | |
|---|---|---|---|
| 88/09709 | 12/1988 | World Int. Prop. O. | 280/32.6 |

*Primary Examiner*—Kenneth J. Dorner
*Assistant Examiner*—Milton Nelson, Jr.
*Attorney, Agent, or Firm*—Hovey, Williams, Timmons & Collins

[57] ABSTRACT

A support apparatus for supporting a user in a plurality of working positions includes a seat supported on a frame and a seat back connected to the frame for movement between a plurality of angular positions ranging between a horizontal position and an upright position. The seat back is positioned in any of the angular positions by a carriage which supports the seat back for pivotal movement about a horizontal axis and by a shifting structure which carries out translational movement of the seat back relative to the pivot axis during pivoting movement of the seat back. The shifting structure shifts the seat back toward the seat during pivotal movement toward the horizontal position and away from the seat during pivotal movement toward the upright position so that the positional relationship between the seat back and the back of a user is preserved.

9 Claims, 3 Drawing Sheets

LOW-PROFILE POSITIONING APPARATUS

BACKGROUND OF THE INVENTION

1. Field of the Invention

The present invention relates generally to support devices and, more particularly, to a support apparatus for selectively supporting a user in one of a plurality of working positions ranging between a horizontal supine position and an upright seated position.

2. Discussion of the Prior Art

Many manufacturing operations presently exist which require individuals to position themselves in any of a number of positions ranging between a substantially horizontal supine position in which the individual is more or less on his or her back, and an upright seated position. For example, in the aviation industry, during the construction and maintenance of an aircraft, numerous hours are spent by workers performing operations beneath the wings or fuselage thereof or in and around the aircraft's landing equipment.

Typically, in the construction of aircraft, a partly assembled plane is supported on a plurality of screw jacks, at least one of which supports either the front or rear of the fuselage and at least two of which are positioned beneath the wings. Once supported in this manner, the plane may be moved if desired from one station to another along an assembly line so that different assembly operations may be performed on the plane. At several of these assembly stations, work is carried out by as many as three to five workers working simultaneously together beneath the plane in and around the support jacks.

Because the workers must perform these assembly operations in cramped quarters with substantially no head room, they are often in uncomfortable working positions for a substantial portion of time. Thus, frequent breaks are necessitated in order to prevent the workers from being over-stressed or cramped.

Although the need for an adjustable worker support chair is particularly acute in the aviation industry, a similar problem exists in other fields where workers must position themselves for long time periods in work stations below an overhead structure where it is uncomfortable to maintain the required position for an extended interval.

Creepers have long been available to support workers during repair operations on the underside of automobiles, trucks, tractors and similar equipment but these devices are not useful when the worker is unable to reach a point above him from his back and must lift himself from the rollable creeper. It would be very tiring to maintain such a position for any significant length of time.

According to U.S. Pat. No. 4,957,302, to Maxwell, a support apparatus is provided which addresses the need for providing a device that will permit workers to stay at their job for longer periods of time by providing ergonomic support for the workers in a plurality of different positions ranging from a substantially horizontal supine position in which the workers are more or less on their backs to an upright seated position.

However, although the known device is capable of supporting an individual comfortably throughout this wide range of movement, the device is of a height which restricts its use to areas having sufficient clearance, e.g. of about 3 feet, to permit a user supported on the device to pass beneath a structure. Thus, there remains a need for a support device having the beneficial adjustability of the known device, while providing a low profile which permits a user supported on the device to access areas having a height of less than about 3 feet.

OBJECTS AND SUMMARY OF THE INVENTION

It is an object of the present invention to provide a support apparatus which permits a full range of movement between a supine position and a seated position while providing ergonomic comfort at any selected position. By providing such a construction it is an additional object of the invention to provide a support apparatus which permits a worker to remain comfortably at a work station for longer periods of time without requiring a break in order to increase the productivity of the worker.

Further, it is an object of the invention to provide a support apparatus small enough to be used in an around aircraft support structures commonly employed in the aviation industry and which are sized to permit a plurality of such support apparatuses to be employed side-by-side in a cramped spaced as exists in numerous types of work environments.

Another object of the invention is to provide a support apparatus having a low profile capable of supporting a user at a height of between 1.5–3.5 feet in order to permit the user to move beneath low-clearance structures and to then raise himself to a more upright position in order to work on the structures. For example, one foreseeable use for an apparatus constructed in accordance with the invention would be in inspecting aircraft construction, wherein an inspector moves beneath and around the underside of a low-clearance fuselage inspecting work at various heights above the floor that would normally require the inspector to move between a creeper and a squatting, bent-over position.

In accordance with these and other objects evident from the present description, a support apparatus includes a seat supported on a frame and a seat back connected to the frame for movement between a plurality of angular positions ranging between a horizontal position and an upright position. The apparatus is provided with reclining means for positioning the seat back in any of the plurality of angular positions. The reclining means includes carriage means for supporting the seat back for pivotal movement about a horizontal axis and shifting means for carrying out translational movement of the seat back relative to the pivot axis during pivoting movement of the seat back. The shifting means shifts the seat back toward the seat during pivotal movement toward the horizontal position and from the seat during pivotal movement toward the upright position so that the positional relationship between the seat back and the back of a user is preserved when the seat back is moved between the plurality of angular positions.

By this construction, numerous advantages are realized. For example, by providing an apparatus in accordance with the invention, a user is able to adjust the position of the seat back in a simple manner while remaining seated, and the position of the seat back relative to the user's back and head is preserved during movement of the seat back. In this manner, the seat back is prevented from rising up the user's back as the user drops the seat back toward a horizontal position, and is thus easier and more comfortable to use than are known devices.

Also, by providing an apparatus in accordance with the invention, it is possible for a worker or inspector to sit on the apparatus and to position themselves in a horizontal position so as to be able to pass beneath low clearance structures and to then raise themselves on the apparatus to a desired position.

One problem encountered in known devices having adjustable back supports resides in the structural relationship between the back supports and the user. Specifically, in known devices, a back support is mounted for pivotal movement relative to a seat about an axis located beneath the user. Because the user reclines about an axis defined by the user's hips, the user's back reclines along an arc different from the arc followed by the back support. This difference in the paths of movement of the user's back and the back support causes the back support to rise up the user's back as the user reclines in the apparatus. This relative movement between a back support and the user causes discomfort and renders adjustment of the back support more difficult. By providing an apparatus constructed in accordance with the invention, this problem is overcome.

BRIEF DESCRIPTION OF THE DRAWING FIGURES

A preferred embodiment of the present invention is described in detail below with reference to the attached drawing figures, wherein.

DETAILED DESCRIPTION OF THE PREFERRED EMBODIMENT

Figure 2:
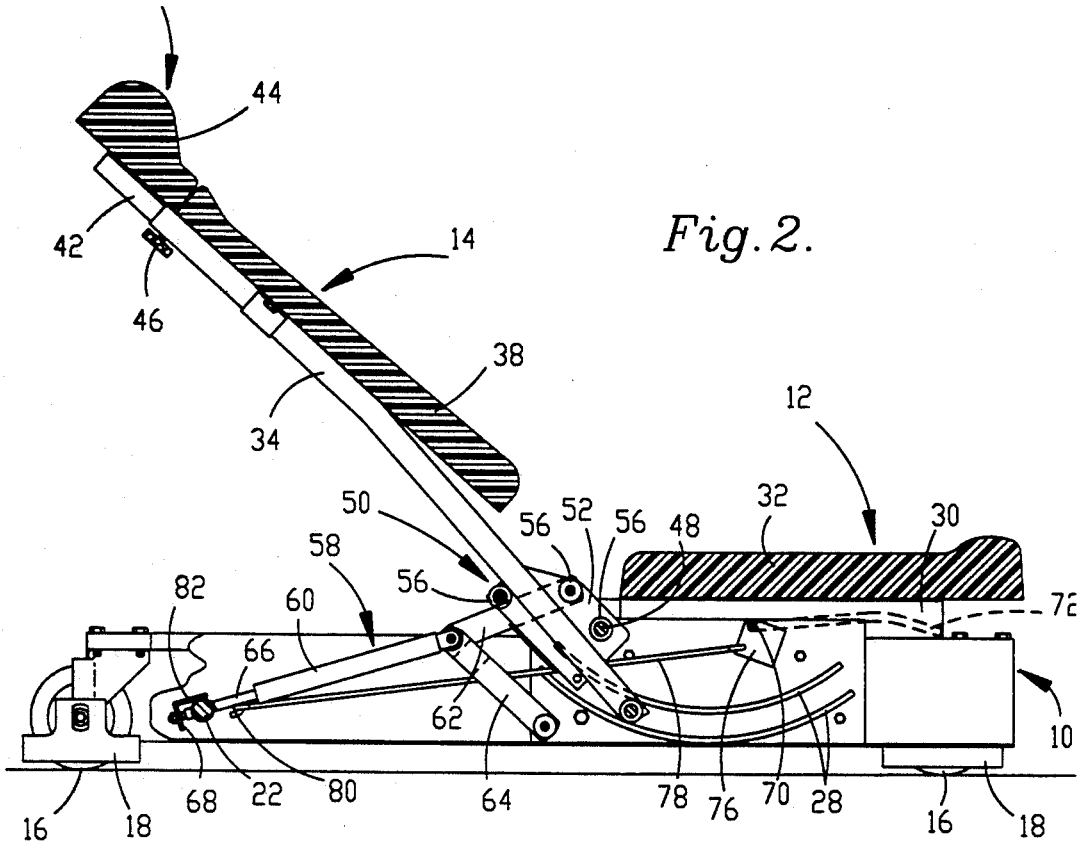
FIG. 2 is a side elevational view, partially in section, of the apparatus, illustrating the seat back in an intermediate position.

Turning first to FIG. 2, a low-profile positioning apparatus is illustrated that is constructed in accordance with a preferred embodiment of the present invention.

Figure 3:
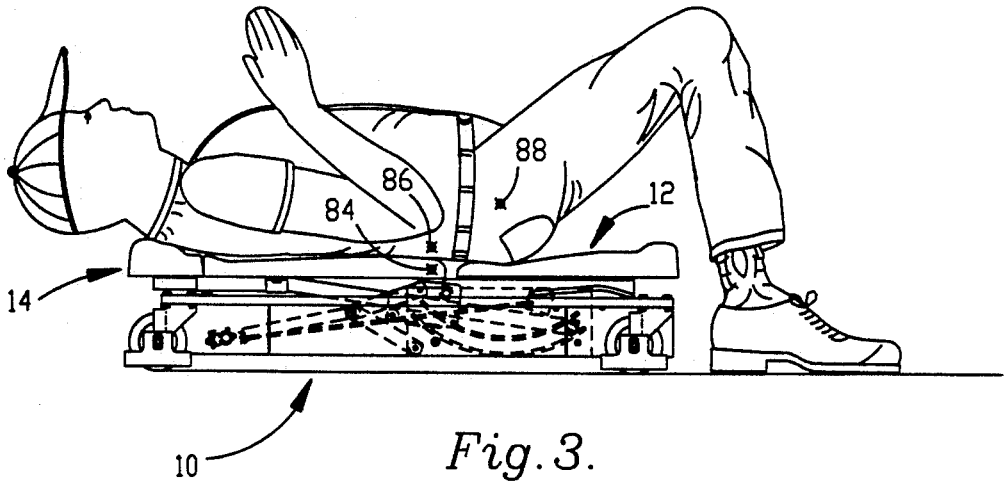
FIG. 3 is a side elevational view of the apparatus illustrating the seat back in a horizontal position.
Figure 5:
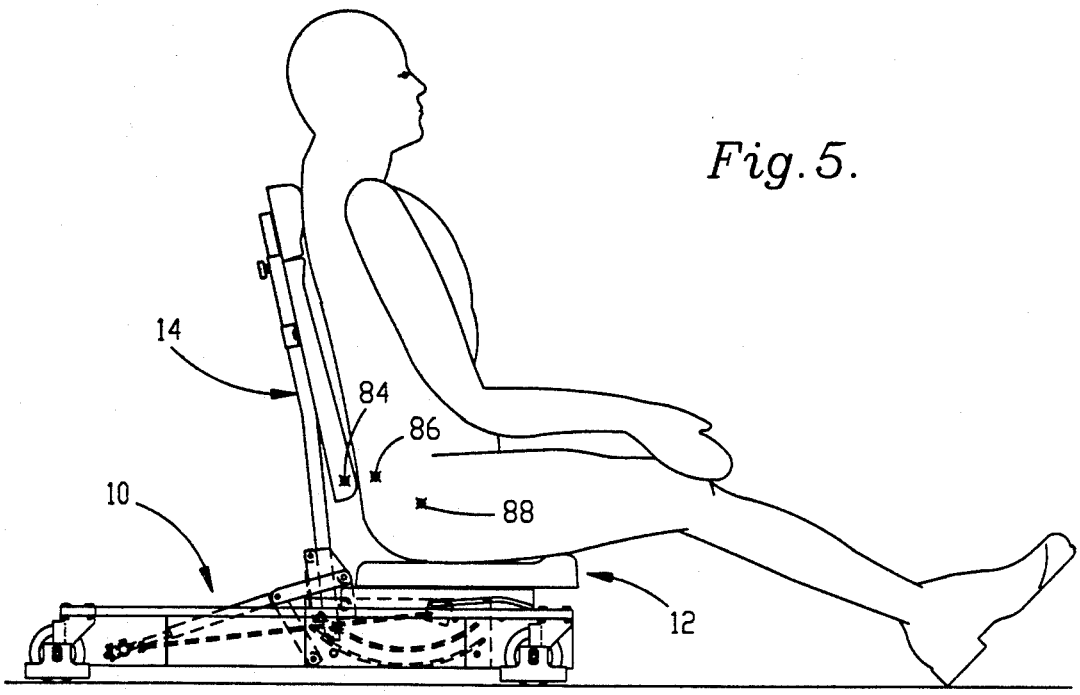
FIG. 5 is a side elevational view of the apparatus illustrating the seat back in an upright position.

The apparatus broadly includes a frame 10, a seat 12 supported on the frame, and a seat back 14 connected to the frame for movement between a plurality of angular positions ranging between a horizontal position, as shown in FIG. 3, and an upright position, as shown in FIG. 5. A reclining means for positioning the seat back in any of the plurality of angular positions, as discussed more fully below, is also illustrated in FIG. 2.

The frame 10 is preferably supported on a plurality of rollers 16, each of which is secured to the frame by a bracket which permits the roller to pivot in any direction so that the frame may be positioned in any desired orientation beneath a structure on which work is to be carried out by the user. Cable guards 18 are associated with each of the rollers and function to protect any cables lying on the ground from being run over by the rollers. These cable guards are of particular utility in environments where pneumatic tools are used.

According to another aspect of the invention, the frame may be placed on elevated rails within a fuselage or the like in order to permit an individual to push the apparatus along the rail in order to carry out operations on the interior ceiling of the fuselage. Alternately, the apparatus may be supported on top of a conventional lift device.

Figure 1:
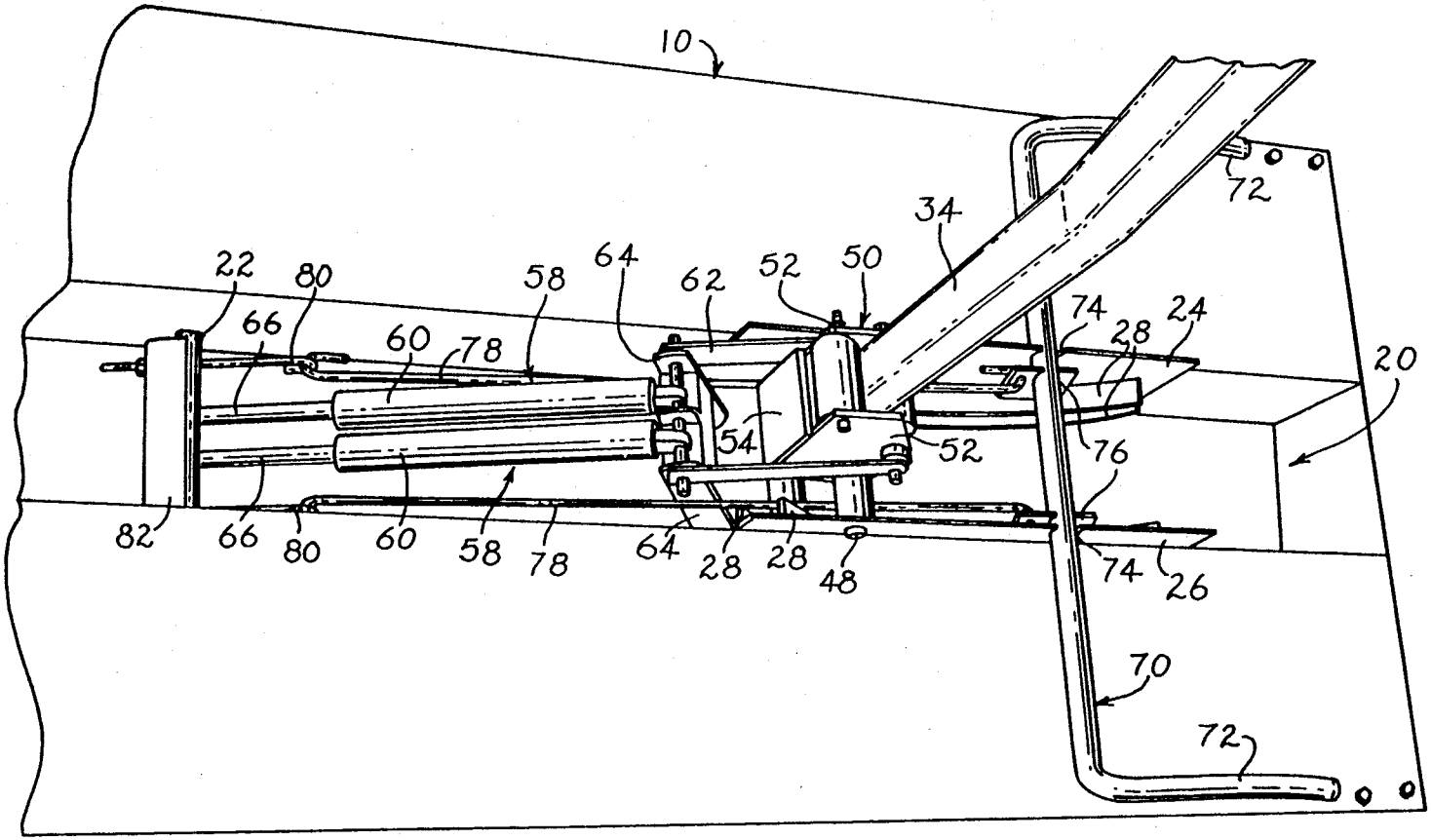
FIG. 1 is a perspective view of the frame of a positioning apparatus constructed in accordance with a preferred embodiment of the present invention, with the seat and seat back of the apparatus removed, illustrating various aspects of the invention.

As shown in FIG. 1, the frame 10 is provided with a central channel 20 in an upper surface thereof. A rotatable transverse rod 22 extends across the channel adjacent the rear end of the frame, and a pair of guideway plates 24, 26 are fastened to the lateral side walls of the channel at a position forward of the rod 22. Each of the guideway plates 24, 26 is provided with a pair of vertically spaced flanges 28 that define an arcuate guideway having a center of curvature located vertically above the seat at a position adapted to coincide with the natural axis of pivot of a user seated on the apparatus.

In the preferred embodiment of the invention, the shape of the guideways defined by the flanges 28 is a circular arc. However, it is understood that other arcuate shapes may be used in accordance with the operation discussed below. The guideway plates are secured to the frame by any suitable means and are prevented from moving relative thereto.

Returning to FIG. 2, the seat 12 is shown as including a rigid seat member 30 that is secured to the frame, and a cushion 32 supported on top of the seat member. Although the seat 12 is illustrated as being fixed relative to the frame 10 in order to present the lowest profile possible, it is possible to construct the seat in such a way as to permit adjustment thereof in any direction relative to the frame.

The seat back 14 includes an elongated, hollow tubular member 34 having an angle formed at an intermediate location and a pair of support rollers 36 positioned at one end of the member and extending in a direction transverse to the longitudinal axis of the member. The support rollers 36 are laterally spaced from each side of the tubular member 34 and are received within the guideways defined by the flanges 28.

A cushion 38 is secured to the tubular member 34 adjacent an end of the member opposite the support rollers 36. A head rest 40 is also secured to the tubular member and includes a tubular support 42 sized for receipt within the member 34, and a cushion 44 fastened to the tubular support. It is possible to provide adjustment of the position of the head rest relative to the seat back by sliding the tubular support 42 into and out of the member 34. A threaded fastener or other suitable means 46 may be provided for securing the head rest once it has been moved to a desired position.

As previously mentioned, a reclining means is provided for positioning the seat back in any angular position between horizontal and upright positions. The reclining means includes a carriage means for supporting the seat back 14 for pivotal movement about a horizontal axis defined by a shaft 48 and a shifting means for carrying out translational movement of the seat back relative to the pivot axis during pivoting movement of the seat back. The shifting means shifts the seat back toward the seat 12 during pivotal movement toward the horizontal position and away from the seat during pivotal movement toward the upright position so that the positional relationship between the seat back and the back of a user is preserved during adjustment of the seat back.

As shown in FIG. 1, the carriage means includes a carriage 50 constructed of a pair of spaced side walls 52 supported on the shaft 48 extending between and connected to the guideway plates 24, 26. The side walls 52 are connected together by a back plate 54, and the carriage may be pivoted about the shaft 48 within the central channel 20 of the frame 10. Returning to FIG. 2, upper, intermediate and lower bearing rollers 56 extend between the side walls of the carriage and define a throat within which the tubular member 34 of the seat back 14 is received. The rollers 56 are rotatable in order to facilitate relative movement between the seat back and the carriage, but bear against the tubular member in order to establish the angular orientation of the seat back relative to the frame and seat of the apparatus.

The structure of the shifting means has already been described and includes the guideways defined by the flanges 28 on the guideway plates supported on the frame 10 and the support rollers 36 at the lower end of the tubular member 34 of the seat back 14. In any given position of the seat back, the combination of support provided by the support rollers 36 in the guideways and by the bearing rollers 56 of the carriage 50 on the tubular member 34 orient the seat back in a particular angular position relative to the seat and support the seat back.

As shown in FIG. 1, a pair of gas spring assemblies 58 are provided within the central channel of the frame and extend between the frame and the carriage. Although two gas spring assemblies are illustrated, it is understood that any number of such assemblies may be employed in order to achieve the desired operation of the apparatus. Each gas spring assembly includes a cylinder 60 connected to the carriage 50 by a pair of force transmitting links 62 and to the guideway plates 24, 26 by a pair of stabilizing links 64. A rod 66 is associated with each cylinder and includes a free end extending completely through the transverse rod 22. As is conventional with known gas spring assemblies, a button 68 is provided at the free end of each rod, as shown in FIG. 2, for unlocking the rod relative to the cylinder so that the rod is free to slide within cylinder.

When the button 68 is released, the piston rod 66 is locked relative to the cylinder 60 and no further relative movement is permitted until the button is again depressed. Preferably, a spring is provided in the cylinder which biases the piston rod toward an extended position so that, once unlocked, the rod is biased toward the elongated position. In this manner, when the buttons 68 are depressed, the gas spring assemblies urge the carriage 50, and thus the seat back 14, toward the upright position. In this manner, a power-assisted lifting means is provided for exerting a lifting force on the carriage when the button is depressed to assist movement of the seat back toward the upright position.

Although not shown in the drawing, it is possible to provide means for exerting an additional lifting force on the seat back. For example, a tension spring extending between the shaft on which the cylinders are supported and a transverse pin provided on the carriage may be provided in order to increase the lifting force exerted on the carriage.

An actuating assembly is provided on the apparatus for permitting a user to actuate the buttons at the ends of the rods while remaining seated. The assembly includes a handle bar 70 having a pair of handles 72 disposed beneath the seat cushion 32 and laterally outward from the member 30 so that a user sitting on the cushion is able to simply reach beneath the seat and pull up on the handles.

Movement of the handle bar is pivotal within a pair of slots 74 provided in the guideway plates 24, 26, the handle bar being retained in the slots when the seat is fastened to the frame. A pair of plates 76 are affixed to the handle bar for movement therewith, and tension members 78 extend between the plates and a pair of J-shaped rods 80 which, in turn, extend through the transverse rod 22 provided on the frame. The J-shaped rods 80 are attached to an L-shaped plate 82 including a first side which rests against the transverse rod 22 and a second side bearing against the buttons 68.

When the handles 72 are pulled upward, the bar 70 pivots causing the tension members 78 to be pulled forward relative to the frame. The J-shaped rods 80 are also pulled forward by this action relative to the transverse rod and bring the second surface of the plate 82 into depressing engagement with the buttons 68 in order to unlock the rods 66 within the cylinders 60.

When a user is positioned on the apparatus in a horizontal, supine position as shown in FIG. 3, the user and apparatus present a low-profile which is capable of passing beneath low-clearance structures as close to the ground as 1.5 feet. Thus, the user is able to work on such low-clearance structures or to pass beneath them in order to access areas interior of such structures.

If the user desires to sit up on the apparatus, he or she merely places either or both hands beneath the seat and pulls up on the handles 72 causing the buttons 68 of gas spring assemblies 58 to be depressed. Thereafter, as the user raises herself toward an upright position, the gas spring assemblies exert a lifting force on the carriage 50 through the force transmitting links 62, and the carriage pulls the seat back 14 toward an upright position. During this pivotal movement of the carriage and seat back, the support rollers 36 are forced toward the rear of the frame within the guideways defined by flanges 28 such that the seat back is translated within the throat of the carriage toward an extended position.

Figure 4:
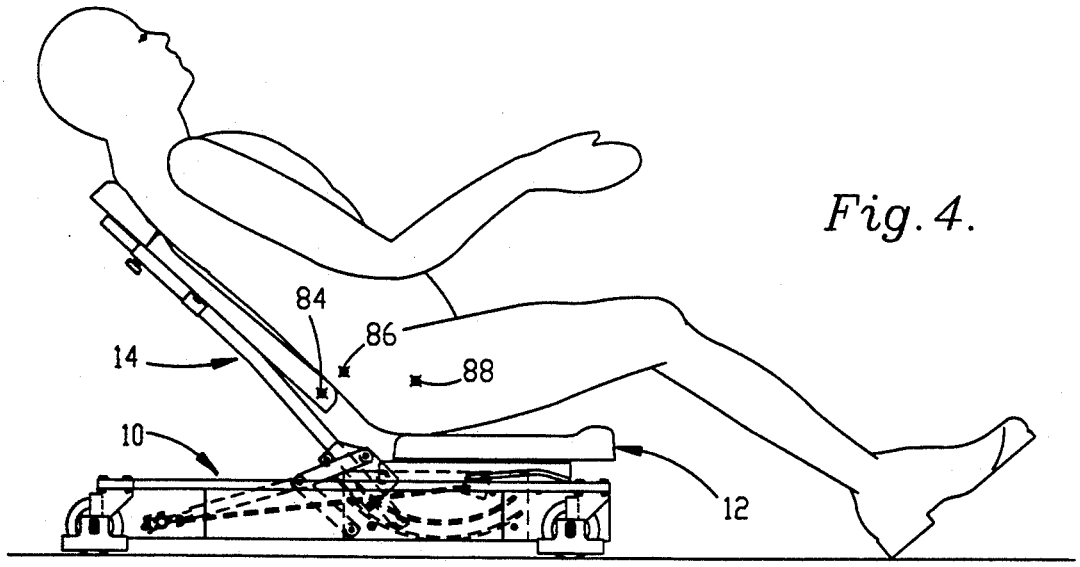
FIG. 4 is a side elevational view of the apparatus illustrating the seat back in an intermediate position.

Once the seat back 14 has been raised to a desired position, e.g. an intermediate position such as that shown in FIG. 4, the user releases the handles so that the buttons are disengaged and the rods 66 are locked in position relative to the cylinders 60. In this manner, the gas spring assemblies 58 define a locking means for locking the carriage once the seat back has been moved to one of the plurality of angular positions desired by the user, as well as a release means for releasing the locking means and the carriage to permit adjustment of the angular position of the seat back.

Further adjustment of the seat back in any position toward the upright position is carried out in a manner similar to that just described, with the range of movement extending completely between the horizontal position, as shown in FIG. 3, and an upright position, as shown in FIG. 5.

In order to lower the seat back, it is again necessary for the user to pull up on the handles 72 in order to unlock the rods 66 for movement within the cylinders 60. Thereafter, the user simply reclines against the seat back, applying her weight in opposition to the lifting force exerted on the seat back by the gas spring assemblies, so that the seat back is pressed downward. Once the user has pushed the seat back to a desired position, the handles are released so that the seat back is locked in that position.

Because the seat back moves in a translational manner relative to the carriage while pivoting with the carriage, the positional relationship between the seat back and the back of the user is preserved when the seat back is moved between the plurality of angular positions. A reference point 84 on the seat back is illustrated in FIGS. 3, 4 and 5, as is a reference point 86 on the lower back of an individual seated on the apparatus.

During a reclining motion, the individual pivots about an axis 88 that is located above the seat 12. Thus, the arc formed by movement of the reference point 86 on the individual during a reclining motion follows a circular path that would normally intersect and pass within the circular path followed by the reference point 84 on the seat back if the seat back followed a truly circular path. However, because the seat back moves in a translational direction as well as the pivotal direction, the reference point 84 on the seat back follows a cycloidal path which, within the range of movement of the seat back, closely matches the arcuate path followed by the reference point 86 on the individual.

In this manner, the seat back remains in substantially the same position relative to the user's back during adjustment of the seat back, and does not tend to ride up the back of the user during reclining movements or to slide down the back of the user when the seat back is being raised. This change in the relationship between the support apparatus and an individual using the apparatus provides significant ergonomic benefits by reducing the discomfort normally experienced in the use of conventional support devices and by improving the user friendliness or "feel" of the apparatus.

Although the invention has been described with reference to the preferred embodiment illustrated in the attached drawing figures, it is noted that substitutions may be made and equivalents employed herein without departing from the scope of the invention as recited in the claims.

What is claimed is:

1. A support apparatus for selectively supporting a user in any of a full range of working positions between a horizontal supine position and an upright, seated position, the apparatus comprising:

a frame;

a seat supported on the frame;

a seat back connected to the frame for movement between a full range of angular positions between a horizontal position and an upright position; and a reclining means for positioning the seat back in any of the full range of angular positions, the reclining means including a carriage supported for pivotal movement about a horizontal axis on the frame, the seat back being supported in the carriage so that when the carriage is pivoted relative to the frame, the angular position of the seat back is changed, and a shifting means for carrying out translational movement of the seat back within the carriage during pivoting movement of the carriage so that the seat back is shifted toward the seat when the carriage is pivoted to move the seat back toward the horizontal angular position and is shifted away from the seat when the carriage is pivoted to move the seat back toward the upright angular position.

2. The support apparatus as recited in claim 1, further comprising a head rest connected to the seat back and adjustable between several positions relative to the seat back.

3. The support apparatus as recited in claim 1, wherein the frame includes a plurality of rollers on which the frame is supported.

4. The support apparatus as recited in claim 1, further comprising a locking means for locking the carriage once the seat back has been moved to one of the plurality of angular positions desired by the user.

5. The support apparatus as recited in claim 4, further comprising a release means for releasing the locking means and the carriage to permit adjustment of the angular position of the seat back.

6. The support apparatus as recited in claim 5, further comprising a power-assisted lifting means for exerting a lifting force on the carriage when the release means is activated to assist movement of the seat back toward the upright position.

7. The support apparatus as recited in claim 1, wherein the seat back includes a support roller and the shifting means includes a guideway provided on the frame for receiving the support roller and establishing the translational position of the seat back within the carriage.

8. The support apparatus as recited in claim 7, wherein the guideway is arcuate.

9. The support apparatus as recited in claim 8, wherein the guideway includes a center of curvature disposed at a height above the seat.

* * * * *